US008230782B2

(12) United States Patent
Shih

(10) Patent No.: US 8,230,782 B2
(45) Date of Patent: Jul. 31, 2012

(54) STAMP DIE ASSEMBLY FOR A SELF-INKING STAMPING DEVICE

(75) Inventor: Hsu-Shen Shih, Yuan Kang (TW)

(73) Assignee: Warm Sun Enterprises Co., Ltd., Yongkang (TW)

( * ) Notice: Subject to any disclaimer, the term of this patent is extended or adjusted under 35 U.S.C. 154(b) by 195 days.

(21) Appl. No.: 12/841,794

(22) Filed: Jul. 22, 2010

(65) Prior Publication Data

US 2012/0017786 A1 Jan. 26, 2012

(51) Int. Cl.
*B41K 1/38* (2006.01)
*B41K 1/50* (2006.01)

(52) U.S. Cl. ..... 101/109; 101/104; 101/334; 101/327

(58) Field of Classification Search ..... 101/103, 101/104, 109, 327, 333, 334, 368; *B41K 1/02, B41K 1/04, 1/03, 1/508*
See application file for complete search history.

(56) References Cited

U.S. PATENT DOCUMENTS 5,671,668 A * 9/1997 Shih ..... 101/104
5,709,145 A * 1/1998 Shih ..... 101/109
7,011,024 B1 * 3/2006 Shih ..... 101/334

* cited by examiner

*Primary Examiner* — Leslie J Evanisko
(74) *Attorney, Agent, or Firm* — Ditthavong Mori & Steiner, P.C.

(57) ABSTRACT

A stamp die assembly for a self-inking stamping device has a die bracket and a replaceable stamp die. The replaceable stamp die is mounted detachably on the die bracket via the engagement between the median tab of the replaceable stamp die and the transverse recess of the die bracket, and via the engagement between the side strips of the replaceable stamp die and the keyed recesses of the die bracket. The die bracket has two elongated keyed protrusions parallel with each other and near two side edges. The replaceable stamp die has two guiding channels engaging with the keyed protrusions. Therefore, the related position of the die bracket and the replaceable stamp die is fixed.

3 Claims, 7 Drawing Sheets

STAMP DIE ASSEMBLY FOR A SELF-INKING STAMPING DEVICE

BACKGROUND OF THE INVENTION

1. Field of the Invention

The present invention relates to a stamp die assembly for a stamp, and more particularly to a stamp die assembly for a self-inking stamping device.

2. Description of Related Art

There are several types of stamps available for consumers to choose and one of the types is a self-inking type. A self-inking stamping device allows a user to stamp papers or envelopes continuously.

With reference to FIGS. 7 and 8, a conventional stamp die assembly for a self-inking stamping device comprises a die bracket 40 and a replaceable stamp die 50.

The die bracket 40 has a transverse recess 41 and two clips 42. The transverse recess 41 is formed in a front edge of the die bracket 40. The clips 42 are formed respectively on the opposite sides of the transverse recess 41 and each has a keyed recess 421 formed in the clip 42 close to the transverse recess 41.

The replaceable stamp die 50 is mounted detachably on the die bracket 40 and has a median tab 51 and a resilient plug 52.

The median tab 51 is formed on a top surface of the replaceable stamp die 50, is mounted inside the transverse recess 41 of the die bracket 40. The plug 52 is formed on the top end of the median tab 51, and is mounted between the clips 42. The plug 52 has two side strips 521 formed respectively on two sides and engaging respectively inside the keyed recesses 421 of the clips 42.

Therefore, the conventional stamp die assembly is assembled by the engagement between the median tab 51 and the transverse recess 41 and the engagement between the side strips 521 and the keyed recesses 421. However, those components are formed together at the middle part of the conventional stamp die assembly. The user has to concentrate to align the components; otherwise the die bracket 40 and the replaceable stamp die 50 cannot engage with each other. Furthermore, the die bracket 40 and the replaceable stamp die 50 are easily oblique slightly to each other since the engagement only occurred at the middle part. The obliquity causes the conventional stamp die assembly interferes with other structures in the self-inking stamping device.

To overcome the shortcomings, the present invention provides a stamp die assembly for a self-inking stamping device to mitigate or obviate the aforementioned problems.

SUMMARY OF THE INVENTION

The main objective of the present invention is to provide a stamp die assembly that is easily assembled. The stamp die assembly for a self-inking stamping device has a die bracket and a replaceable stamp die. The replaceable stamp die is mounted detachably on the die bracket via the engagement between the median tab of the replaceable stamp die and the transverse recess of the die bracket, and via the engagement between the side strips of the replaceable stamp die and the keyed recesses of the die bracket. The die bracket has two elongated keyed protrusions parallel with each other and near two side edges. The replaceable stamp die has two guiding channels engaging with the keyed protrusions. Therefore, the related position of the die bracket and the replaceable stamp die is fixed.

Other objectives, advantages and novel features of the invention will become more apparent from the following detailed description when taken in conjunction with the accompanying drawings.

DETAILED DESCRIPTION OF PREFERRED EMBODIMENT

Figure 1:
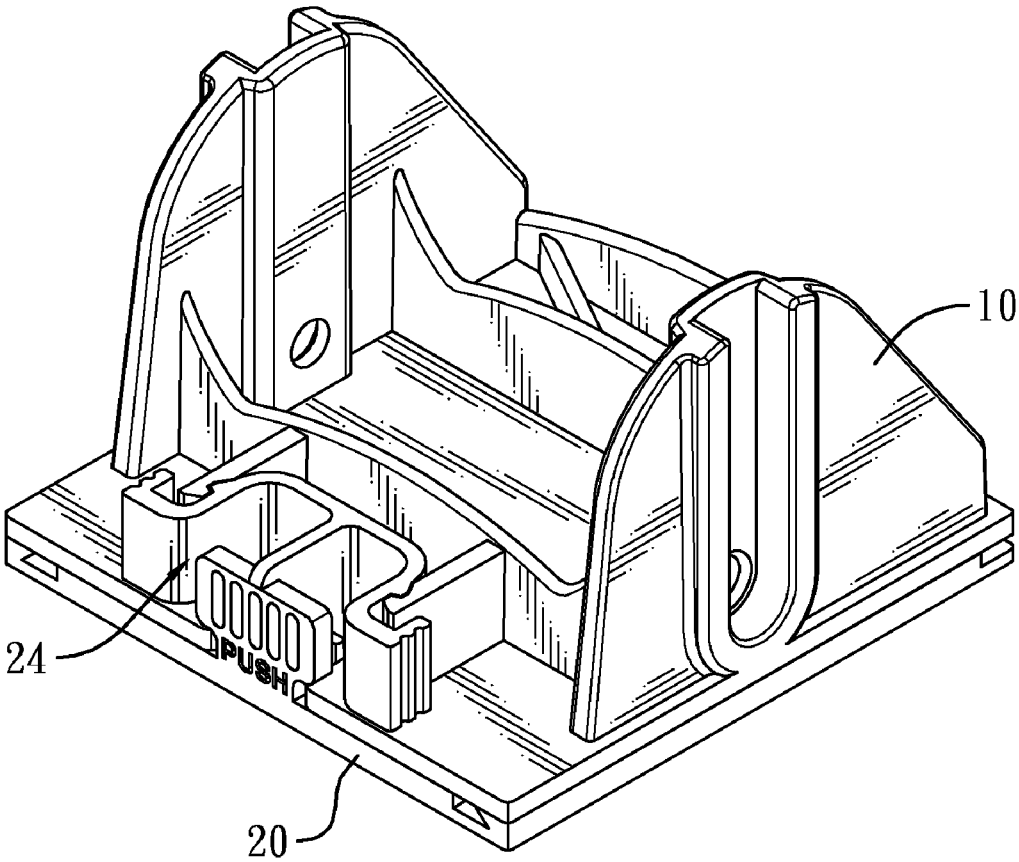
FIG. 1 is a perspective view of the stamp die assembly in accordance with the present invention.
Figure 2:
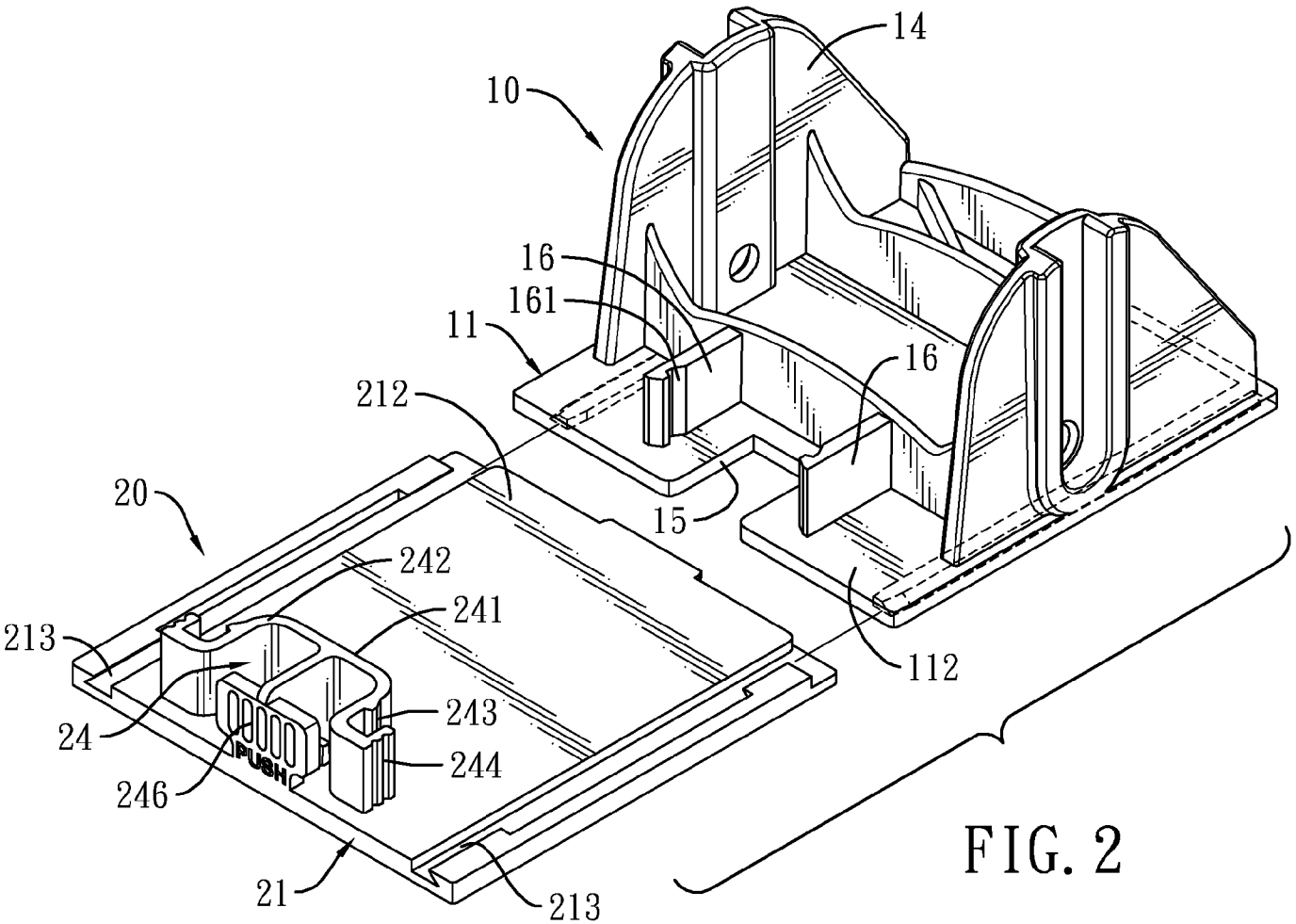
FIG. 2 is an exploded perspective view of the stamp die assembly in FIG. 1.
Figure 3:
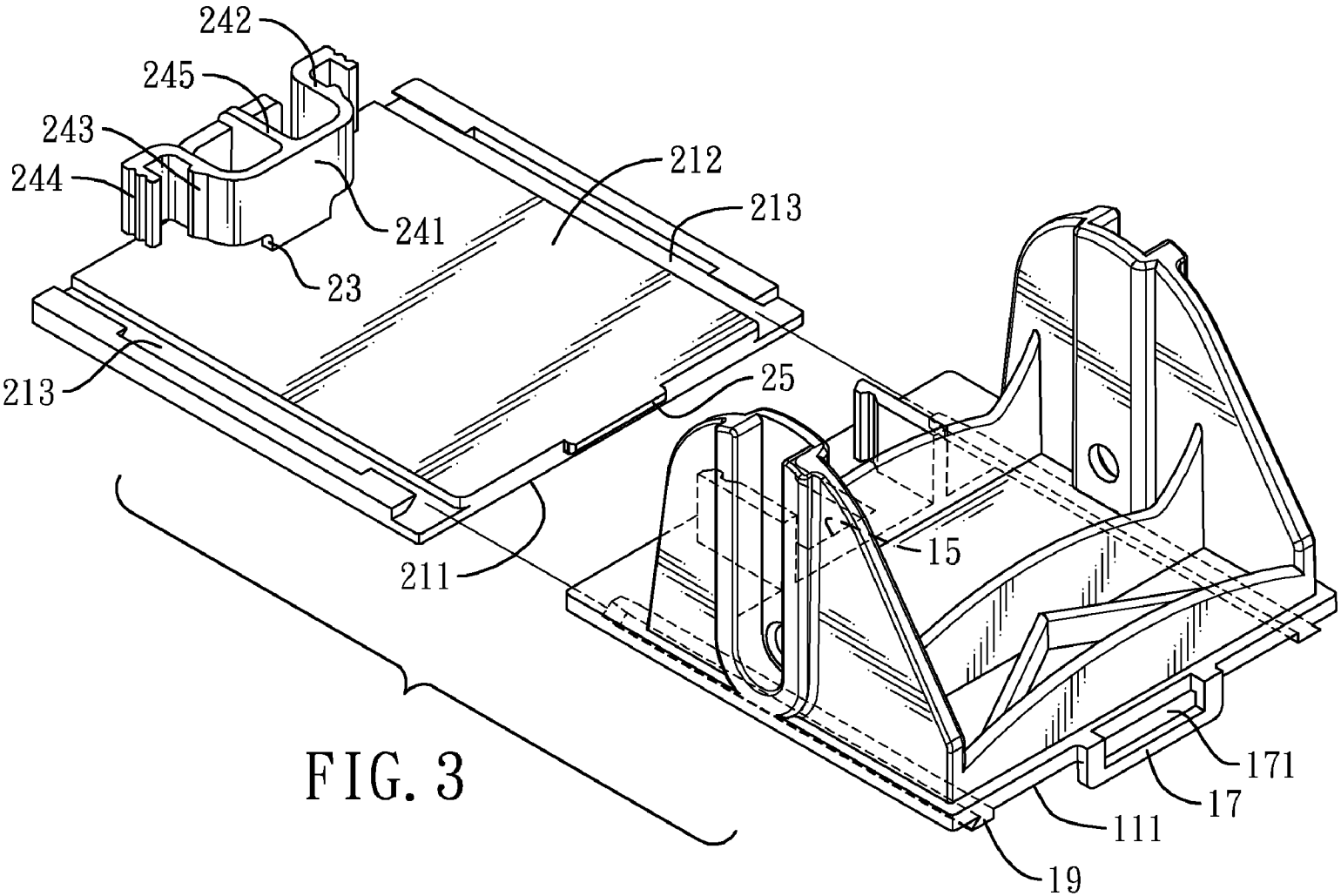
FIG. 3 is another exploded perspective view of the stamp die assembly in FIG. 1.

With reference to FIGS. 1 to 3, a stamp die assembly for a self-inking stamping device accordance with the present invention comprises a die bracket 10 and a replaceable stamp die 20.

The die bracket 10 has a seat 11, two side transverse tabs 14, a transverse recess 15, two clips 16, a fastener bracket 17 and two keyed protrusions 19. The seat 11 has a thickness, a front edge, a back edge, two side edges, a bottom surface 111 and a top surface 112. The side transverse tabs 14 are formed on the top surface 112 respectively on the side edges of the seat 11. The transverse recess 15 is formed through the seat 11 on the front edge. The clips 16 are formed on the top surface 112 of the seat 11, are formed respectively on opposite sides of the transverse recess 15 and each has a keyed recess 161 formed in the clip 16 close to the transverse recess 15. The keyed recesses 161 face each other. The fastener bracket 17 is formed on the back edge of the seat 11 and has a slot 171 formed through the fastener bracket 17. The keyed protrusions 19 are elongated, are formed separately on the bottom surface 111 of the seat 11, are formed respectively near the side edges of the seat 11 and are parallel with each other.

The replaceable stamp die 20 is made of rubber, is mounted detachably on the die bracket 10 and has a die block 21, a fastener 25, a median tab 23 and a resilient plug 24.

Figure 5:
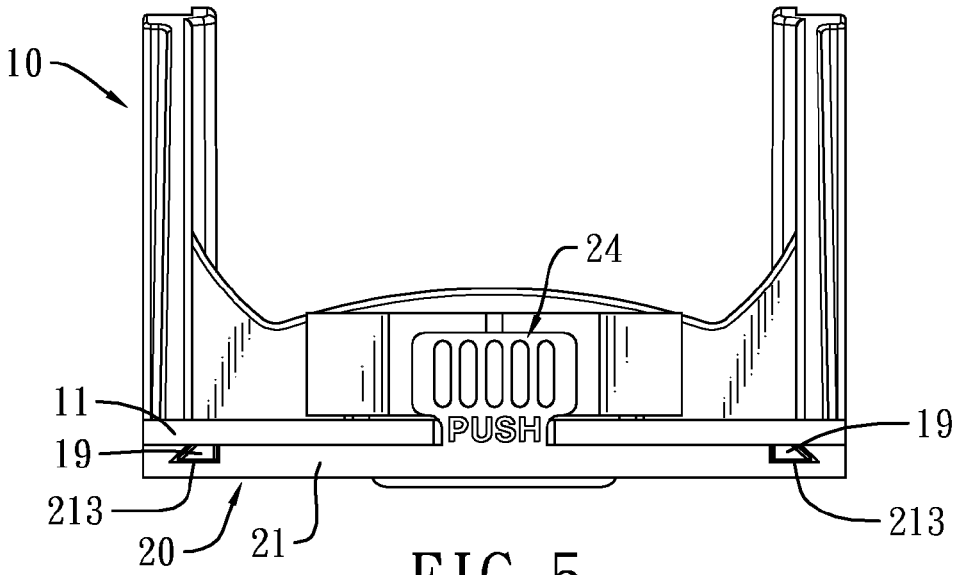
FIG. 5 is a front view of the stamp die assembly in FIG. 1.

With further reference to FIG. 5, the die block 21 is attached to the bottom surface 111 of the seat 11 and has a top surface 212, a patterned surface 211, a front edge, a back edge, two side edges and two guiding channels 213. The top surface 212 of the die block 21 abuts against the bottom surface 111 of the seat 11. The patterned surface 21 is opposite to the die block 21 and has carved patterns or characters. The guiding channels 213 are formed separately in the top surface 212 of the die block 21, are formed respectively near the side edges of the die block 21 and respectively engage with the keyed protrusions 19 of the die bracket 10. Each guiding channel 213 has at least one end opening.

The fastener 25 is formed on the back edge of the die block 21 and extends through the slot 171 of the fastener bracket 17 in the die bracket 10.

The median tab 23 is formed on the top surface 212 of the die block 21, is mounted inside the transverse recess 15 of the die bracket 10 and has a thickness and a top end. The thickness of the median tab 23 is the same as that of the seat 11.

Figure 4:
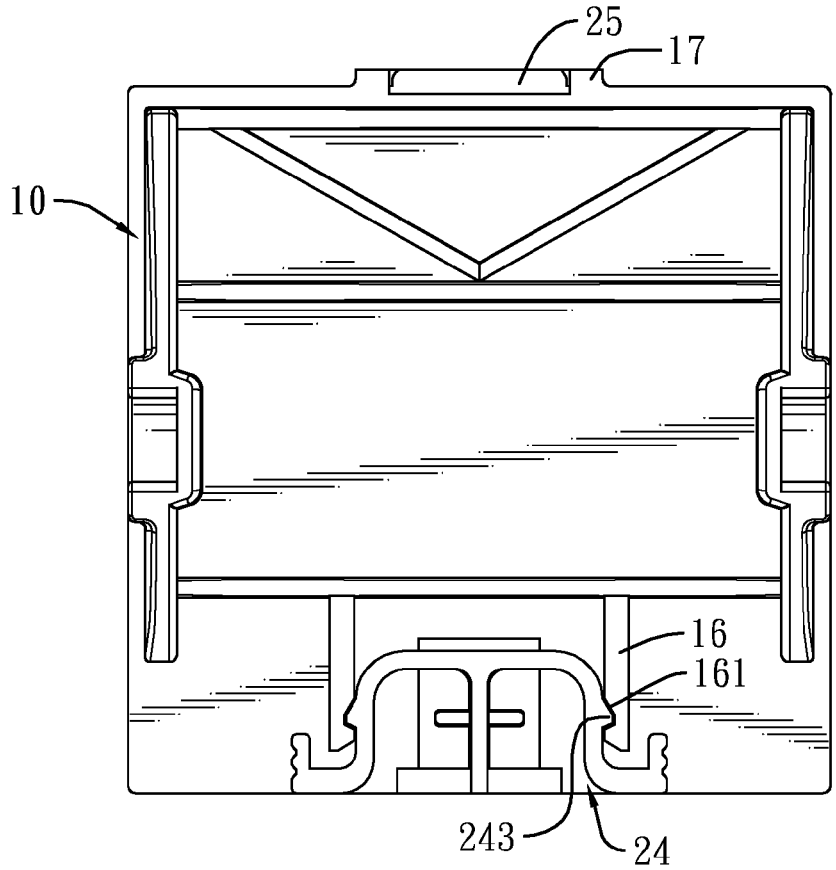
FIG. 4 is a top view of the stamp die assembly in FIG. 1.

With further reference to FIG. 4, the plug 24 is formed on the top end of the median tab 23 and is mounted between the clips 16 of the die bracket 10. The plug 24 has a longitudinal tab 241, two side curved tabs 242, two side strips 243, two releasing tabs 244, a central spine 245 and a push 246. The longitudinal tab 241 is formed on the top end of the median tab 241 and has two sides. The side curved tabs 242 are formed respectively on the sides of the longitudinal tab 242 and urge respectively against the clips 16. Each side curved tab 242 has an outer end. The side strips 243 are formed respectively on the side curved tabs 242 and engage respectively inside the keyed recesses 161 of the clips 16. The releasing tabs 244 are formed respectively on the outer ends of the side curved tabs 242. The central spine 245 is formed on the longitudinal tab 241 between the side curved tabs 242 and has a front end. The push 246 is formed on the front end of the central spine 245 and is located on the front edge of the die block 21.

Figure 6:
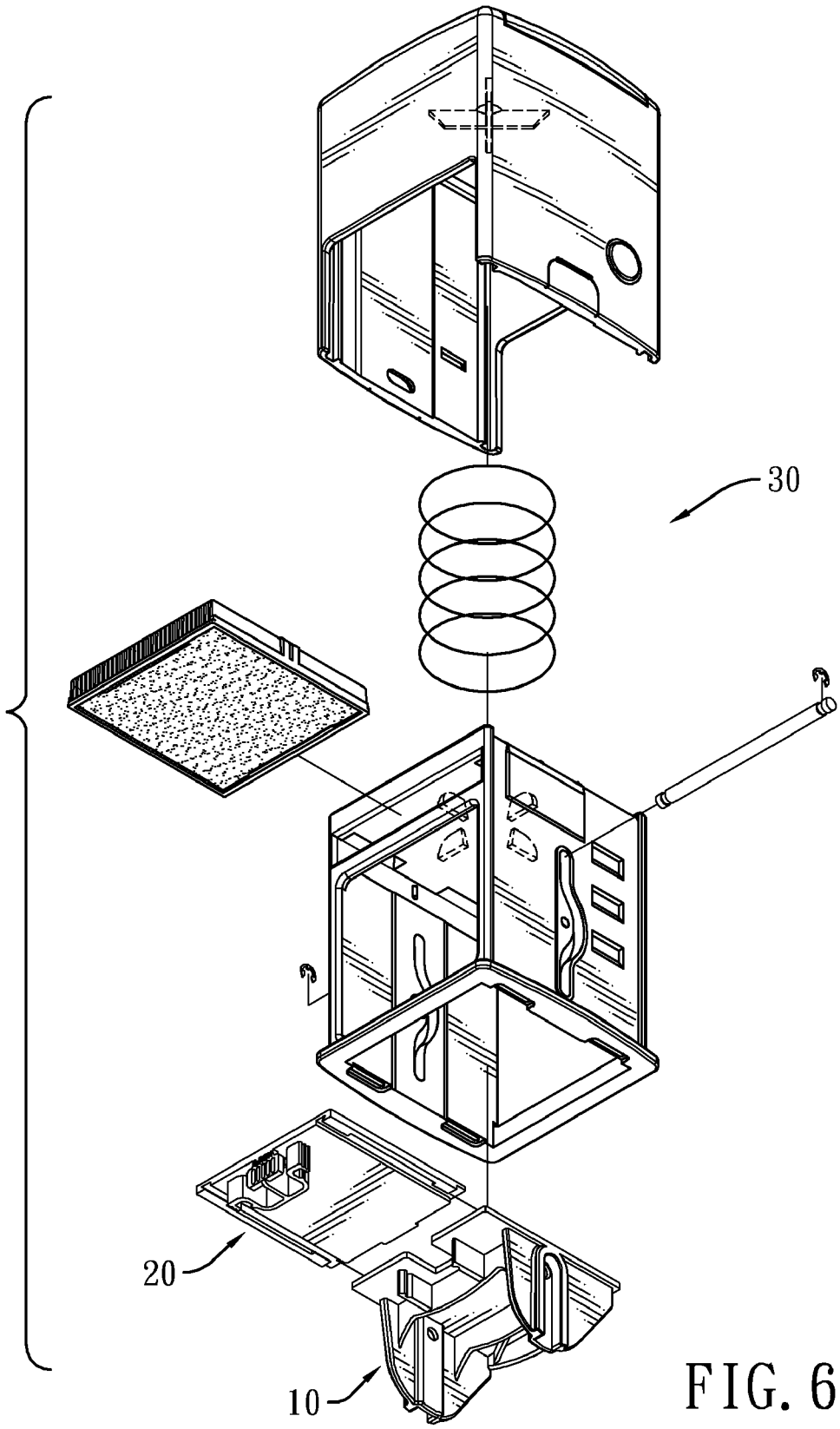
FIG. 6 is an exploded perspective view of a self-inking stamping device with the stamp die assembly in FIG. 1.
Figure 7:
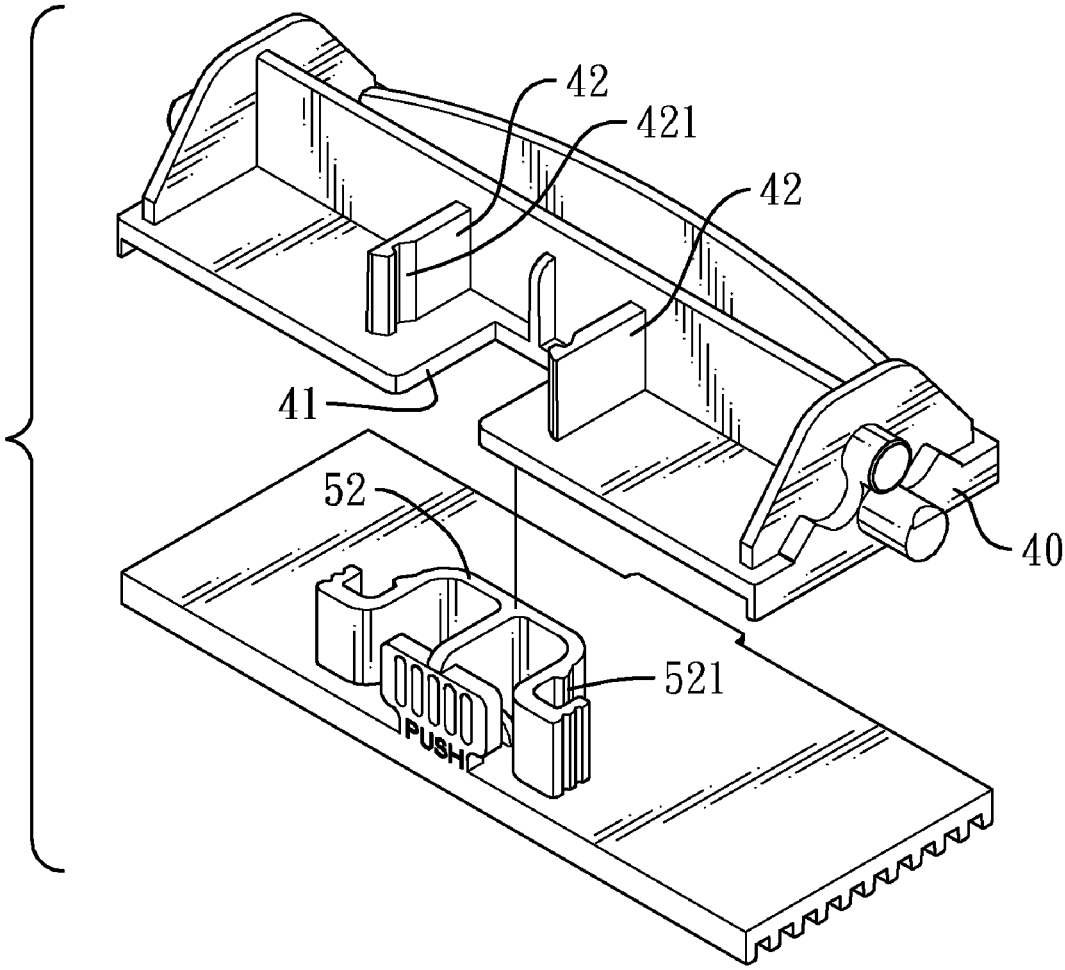
FIG. 7 PRIOR ART
FIG. 7 is an exploded perspective view of a conventional stamp die assembly in accordance with the prior art.
Figure 8:
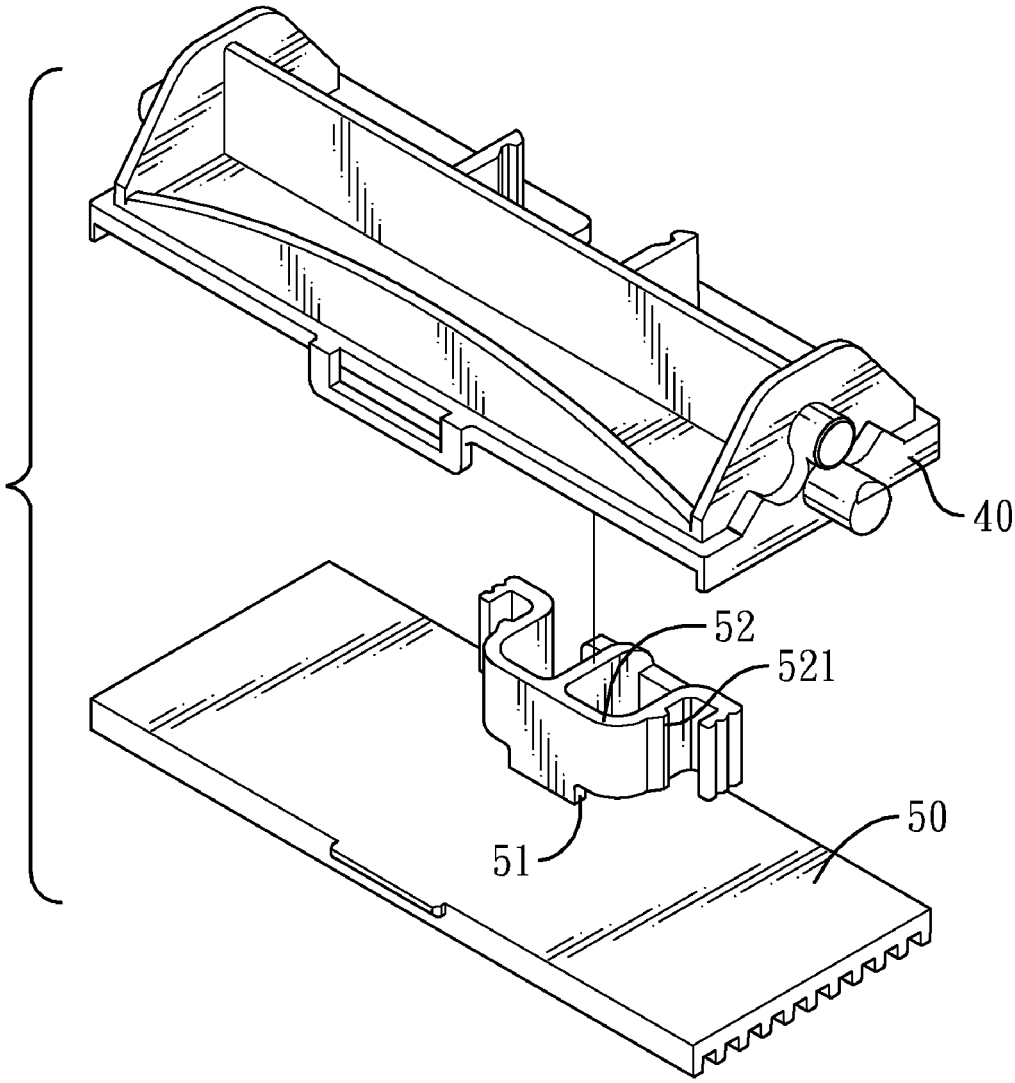
FIG. 8 PRIOR ART
FIG. 8 is another exploded perspective view of the conventional stamp die assembly in FIG. 7.

With further reference to FIG. 6, the stamp die assembly as described is mounted rotatably inside a hollow body of a self-inking stamping device 30 and is driven by a stamp push of the self-inking stamping device 30 to stamp papers or envelopes. As the operation of the self-inking stamping device 30 is conventional and not the focus of the invention, it is described only briefly.

When the die bracket 10 and the replaceable stamp die 20 assembled with each other, the keyed protrusions 19 slide into the guiding channels 213 through the end openings. Since the guiding channels 213 and the keyed protrusions 19 are respectively near two side edges, the related position of the die bracket 10 and the replaceable stamp die 20 is fixed. Therefore, the median tab 23 precisely engages the transverse recess 15 and the side strips 243 precisely engage with the keyed recesses 161 of the clips 16. Thus, the stamp die assembly as described is easily assembled.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A stamp die assembly for a self-inking stamping device comprising:

a die bracket having a seat;

two side transverse tabs formed on a top surface respectively on two side edges of the seat;

a transverse recess formed through the seat on a front edge of the seat;

two clips formed on the top surface of the seat, formed respectively on opposite sides of the transverse recess and each has a keyed recess formed in the clip close to the transverse recess, wherein the keyed recesses face each other;

a fastener bracket formed on a back edge of the seat and having a slot formed through the fastener bracket; and two elongated keyed protrusions formed separately on a bottom surface of the seat, formed respectively near the side edges of the seat and being parallel with each other; and a replaceable stamp die mounted detachably on the die bracket and having a die block attached to the bottom surface of the seat and having a top surface facing the bottom surface of the seat;

a patterned surface opposite to the seat;

a front edge;

a back edge; and two guiding channels formed separately in the top surface of the die block, formed respectively near the side edges of the die block and respectively engaging with the keyed protrusions of the die bracket, and each having at least one end opening;

a fastener formed on the back edge of the die block and extending through the slot of the fastener bracket in the die bracket;

a median tab formed on the top surface of the die block, mounted inside the transverse recess and having a top end; and a resilient plug formed on the top end of the median tab, mounted between the clips and having a longitudinal tab formed on the top end of the median tab and having two sides;

two side curved tabs formed respectively on the sides of the longitudinal tab, urging respectively against the clips and each having an outer end;

two side strips formed respectively on the side curved tabs and engaging respectively inside the recesses of the clips; and a central spine formed on the longitudinal tab between the side curved tabs and having a front end.

2. The stamp die assembly for a self-inking stamping device as claimed in claim 1, wherein the plug further comprises two releasing tabs formed respectively on the outer ends of the side curved tabs.

3. The stamp die assembly for a self-inking stamping device as claimed in claim 2, wherein the plug further comprises a push formed on the front end of the central spine and located on the front edge of the die block.

* * * * *